US006971598B2

(12) United States Patent
Schillinger et al.

(10) Patent No.: US 6,971,598 B2
(45) Date of Patent: Dec. 6, 2005

(54) CUTTER BODY WITH A BEATER

(75) Inventors: Willi Schillinger, Baiersbronn (DE); Robert Oehler, Zell am Harmersbach (DE); Karl Kammerer, Fluorn-Winzeln (DE)

(73) Assignee: Betek Bergbau- und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 171 days.

(21) Appl. No.: 10/410,870

(22) Filed: Apr. 10, 2003

(65) Prior Publication Data

US 2004/0017955 A1 Jan. 29, 2004

(30) Foreign Application Priority Data

Apr. 10, 2002 (DE) ..... 102 15 833

(51) Int. Cl.[7] ..... B02C 13/28
(52) U.S. Cl. ..... 241/194; 241/195
(58) Field of Search ..... 241/194, 195, 241/293, 294, 295

(56) References Cited

U.S. PATENT DOCUMENTS

| | | | | |
|---|---|---|---|---|
| 1,098,417 A | * | 6/1914 | Wall | 241/294 |
| 3,762,655 A | * | 10/1973 | Brewer | 241/32 |
| 4,998,574 A | * | 3/1991 | Beach et al. | 144/241 |
| 5,639,035 A | * | 6/1997 | Maugle et al. | 241/236 |
| 5,988,544 A | * | 11/1999 | Williams, Jr. | 241/294 |

FOREIGN PATENT DOCUMENTS

DE 43 27 120 C1 1/1995

* cited by examiner

*Primary Examiner*—Mark Rosenbaum
(74) *Attorney, Agent, or Firm*—Pauley Petersen & Erickson

(57) ABSTRACT

A cutter body with a beater having a bearing body, which is penetrated by a bearing bore, wherein a beater head adjoins the bearing body via a connecting section, and the bearing body has lateral faces which receive the bore openings and are arranged on a side, transversely with respect to the bearing axis of the bearing bore. For increasing the operational dependability, at least one of the lateral faces is formed as segments.

12 Claims, 2 Drawing Sheets

CUTTER BODY WITH A BEATER

BACKGROUND OF THE INVENTION

1. Field of the Invention

This invention relates to a cutter body having a beater with a bearing body, which is penetrated by a bearing bore, wherein a beater head adjoins the bearing body via a connecting section, and the bearing body has lateral faces which receive the bore openings and are arranged on its side, transversely with respect to the bearing axis of the bearing bore.

2. Discussion of Related Art

A conventional cutter body is known from German Patent Reference DE 43 27 120 C1. There, base elements of a beater changing system are arranged on a cylinder-shaped base body. Exchangeable beaters are mounted on the base elements. For this purpose, the beaters have a bearing bore in a bearing body. The base body has an aligned receiver bore. A fastening screw can be passed through the bearing bore and the receiver bore and can be secured by a check nut.

The screw head and the nut are supported on the lateral faces which receive the bore openings.

It is known to have two or more beaters arranged side-by-side. In that case the lateral faces of adjoining beaters rest against each other. It can then occur in these cases that the material to be comminuted enters the area between the lateral faces and blocks the free pivoting of the beaters.

SUMMARY OF THE INVENTION

It is one object of this invention to provide a cutter body of the type mentioned above but wherein the danger of jamming of the pivot bearing during operations is definitely reduced.

This object is achieved with at least one of the lateral faces articulated in the form of segments.

With the segment division of the lateral faces, possibly entered comminution material can already be ground down while pivoting a beater, during the operation. Jamming of the pivot bearing is thus assuredly prevented. For articulating the lateral faces, at least one of the lateral faces is divided into segments by grooves, which are arranged concentrically and/or radially relative to the bearing axis.

With the segment division, it is necessary to assure that the adjoining lateral faces of two beaters do not get hooked to each other. This can be easily achieved because at least one circumferential groove is cut into at least one of the lateral faces, which divides two ring-shaped segments.

If a lateral face of a beater is connected to a flat limiting face, then radial grooves, which extend radially relative to the bearing axis over an entire width of the lateral faces extending transversely to the bearing axis, are cut into at least one of the lateral faces.

The comminuted material can be removed via the radial grooves.

For assuring an even bearing load during operation, even with asymmetrically designed beaters, and to prevent a bearing jam, the connecting section can be formed asymmetrically on the bearing body in the direction of the bearing axis and/or can maintain the beater head asymmetrically relative to the bearing axis. The bearing bore is embodied symmetrical with respect to the center transverse plane of the connecting section intersecting the bearing axis, or is embodied symmetrical with respect to the mass center of gravity of the beater in the direction of the bearing axis.

This can be easily achieved, for achieving symmetry, if in a partial area the bearing bore has a clearance which increases the diameter.

A sturdy embodiment of the beater, along with a minimum outlay of material, results if the connecting section is supported on the bearing body by one or several strips.

For reducing the required cutting force, the beater head has one or several cutting shoulders near or in the area in front of the strips, viewed in the feeding direction. The connecting section has a front face in the area between the bearing body and the cutting shoulders, and oblique faces adjoin the front face in the direction of the bearing axis, which are angled on both sides with respect to the feeding direction.

BRIEF DESCRIPTION OF THE DRAWINGS

This invention is explained in greater detail in view of an exemplary embodiment represented in the drawings, wherein.

DESCRIPTION OF PREFERRED EMBODIMENTS

Figure 1:
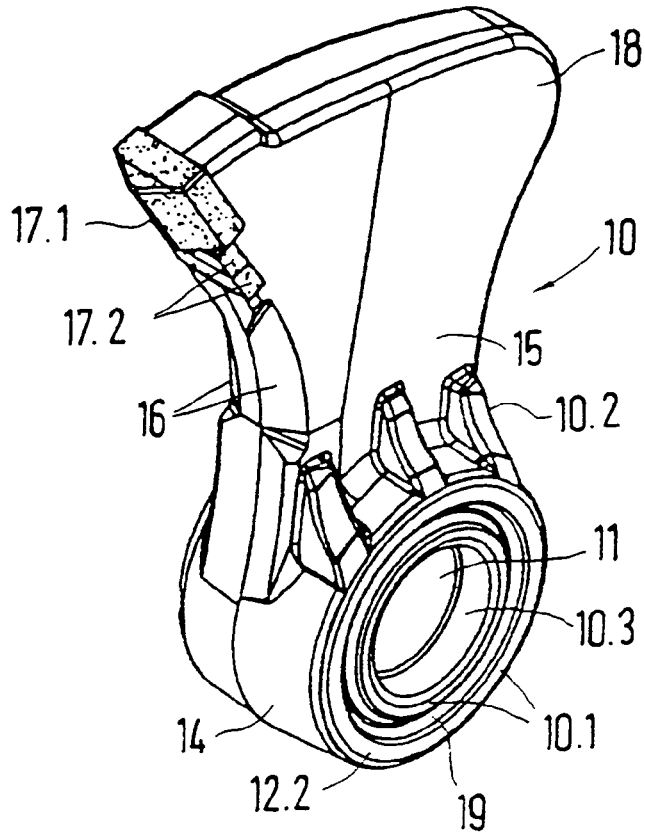
FIG. 1 shows a cutter body in a perspective lateral view from the right.

A cutter body with a beater 10 is shown in FIG. 1, with a bearing body 14, on which a connecting section 15 is formed and projects away from the bearing body 14. In an area facing away from the bearing body 14, the connecting section 15 has a beater head 18 which has at the front, in the feeding direction, two cutter inserts 17.1, 17.2, made of a hard alloy.

In this case the lower cutter insert 17.2 is embodied in two parts, for reducing a breaking danger. The connecting section 15 has a concave front face below the cutter inserts 17.1, 17.2. Two oblique faces 16 adjoin the cutter inserts 17.1, 17.2 and are set at an angle relative to the feeding direction. The front face 16 transitions into the surface of the cutter insert 17.2.

As shown in FIG. 1, for improved bracing, the connecting section 15 is supported on the bearing body 14 by strips 10.2.

Figure 3:
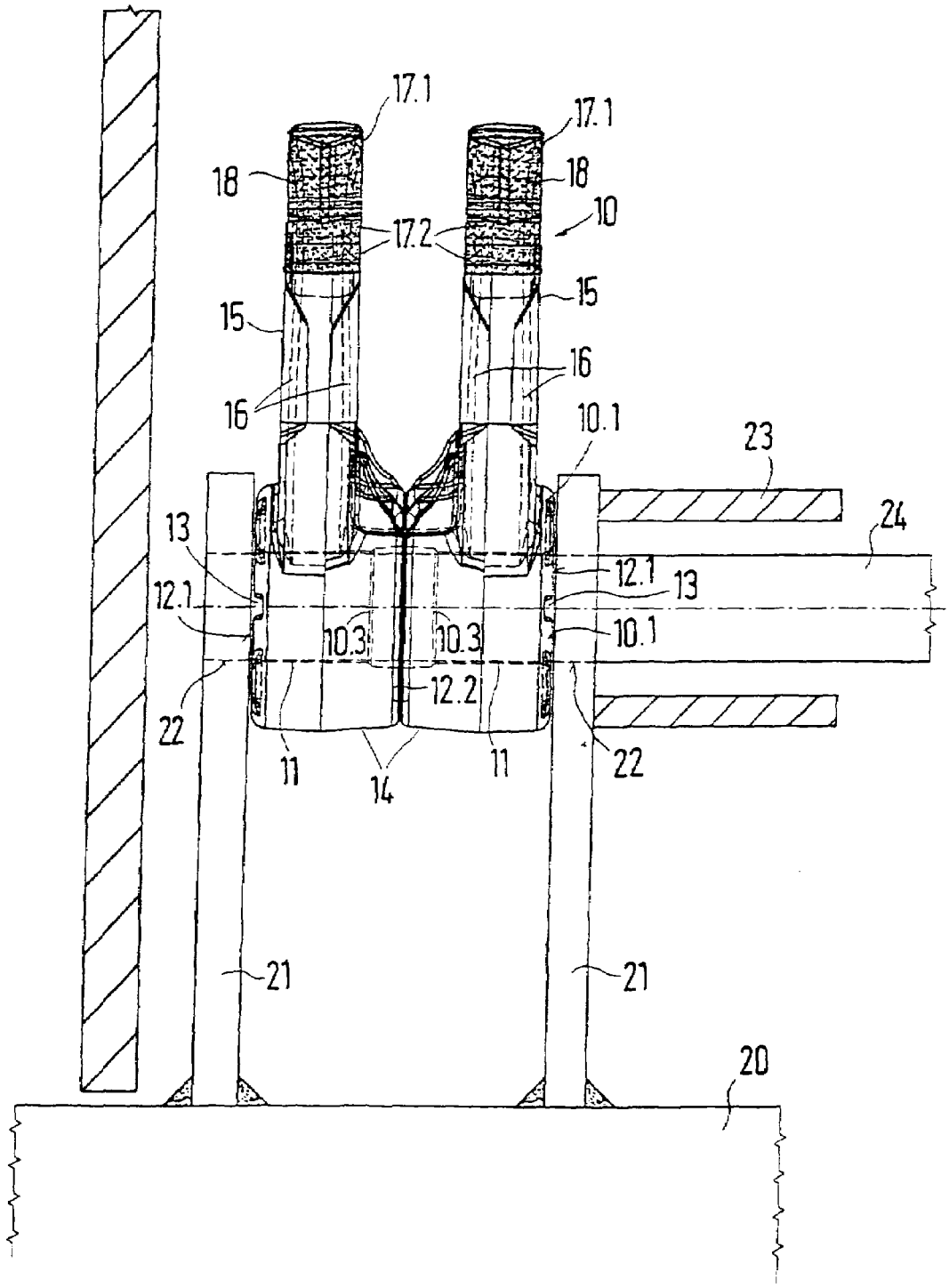
FIG. 3 is a partial representation of a shredding machine with a cylindrical body and assembled beaters in accordance with FIGS. 1 and 2, in a front view.

A bearing bore 11 passes through the bearing body 14 and has a diameter-increasing clearance 10.3 in the area of the right beater side. Thus the actual part of the bearing bore 11 forming the bearing extends symmetrically with respect to the center transverse plane of the connecting section 15, as shown in FIG. 3. An even stress, stable against tilting, of the bearing can thus be achieved.

Figure 2:
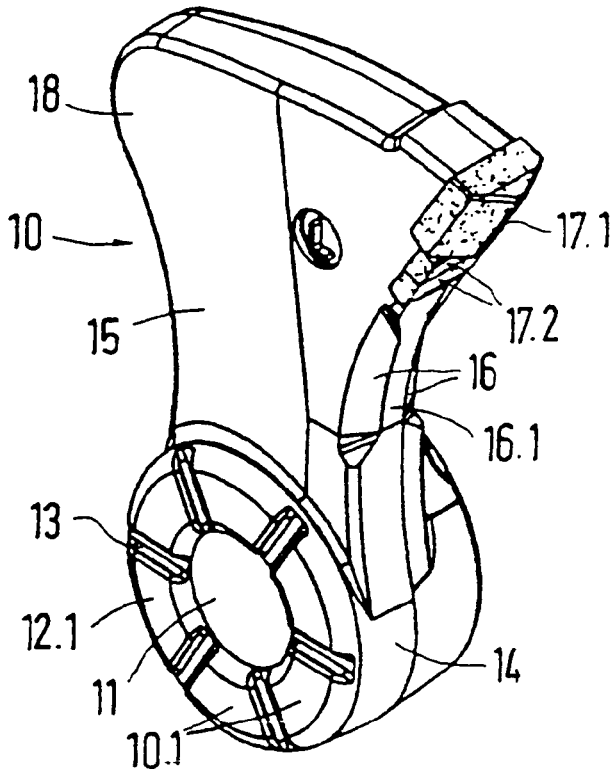
FIG. 2 shows the cutter body of FIG. 1 but in a perspective lateral view from the left.

Near the ends of the bearing bore 11, the bearing body 14 has lateral faces 12.1, 12.2 arranged perpendicularly relative to the bearing axis. As shown in FIG. 1, the right-side bearing face 12.1 is divided into two ring-shaped segments 10.1 by a circumferential groove 19 extending around the bearing axis. FIG. 2 shows that the left-hand lateral face 12.1 is divided into segments 10.1 by radial grooves 13.

A section of a shredding machine is shown in a schematic representation in FIG. 3, and the shredding machine has a cylindrical body 20.

A plurality of radially projecting holding plates 21 are attached to a surface of the cylindrical body 20, for holding beaters 10. In this case the holding plates 21 are radially spaced apart from each other, and a bore 22 passes through each one of the holding plates 21. The bores 22 are aligned with each other. Respectively, two beaters 10 are maintained near or in the area between the holding plates 21. The beaters 10 are designed to be laterally reversed, so that the connecting sections 15 are at an increased distance from each other. The beaters 10 are lined up near or in the area of their lateral faces 12.2, which are divided by the circumferential grooves 19, so that they can pivot with respect to each other without blocking each other.

The oppositely located lateral faces 12.1 are placed at a short distance opposite the surfaces of the holder plates 21 facing them.

For fixing the beaters 10 in place, a bearing shaft 24 can be pushed through the bores 22 of the holding plate 21 and through the bearing bores 11 of the beaters 10. For its protection, the bearing shaft is enclosed in a tube 23. The beaters 10 can be pivoted on the bearing shaft 24. German Patent Reference 102 15 833.9-23, the priority document corresponding to this invention, and its teachings are incorporated, by reference, into this specification.

What is claimed is:

1. In a cutter body having a beater (10) which has a bearing body (14) with a bearing bore (11), wherein a beater head (18) adjoins the bearing body (14) via a connecting section (15), wherein the bearing body (14) has lateral faces (12.1, 12.2) that receive the bore openings and are arranged on sides transversely with respect to a bearing axis of the bearing bore (11), the improvement comprising:

at least one of the lateral faces (12.1, 12.2) being formed in a plurality of segments, and at least one of the lateral faces (12.1, 12.2) divided into segments (10.1) by grooves arranged at least one of concentrically and radially with respect to the bearing axis.

2. In the cutter body in accordance with claim 1, wherein at least one circumferential groove (19) is cut into at least one of the lateral faces (12.1, 12.2), which divides the ring-shaped segments (10.1).

3. In the cutter body in accordance with claim 2, wherein radial grooves (13) which extend radially over an entire width of the lateral faces (12.1, 12.2) extending transversely with respect to the bearing axis, are cut into at least one of the lateral faces (12.1, 12.2).

4. In the cutter body in accordance with claim 3, wherein the connecting section (15) at least one of is formed asymmetrically on the bearing body (14) in a direction of the bearing axis and maintains the beater head (18) asymmetrically in relation to the bearing axis, and the bearing bore is one of symmetrical with respect to a center transverse plane of the connecting section (15) intersecting the bearing axis and symmetrical with respect to a mass center of gravity of the beater (10).

5. In the cutter body in accordance with claim 4, wherein for symmetry the bearing bore (11) has a clearance (10.3) in a partial area, which increases a diameter.

6. In the cutter body in accordance with claim 5, wherein the connecting section (15) is supported on the bearing body (14) by at least one strip (10.2).

7. In the cutter body in accordance with claim 6, wherein the beater head (18) has at least one cutting shoulder (17.1, 17.2) near or in front of the strips, viewed in the feeding direction, the connecting section (15) has a front face between the bearing body (14) and the cutting shoulders (17.1, 17.2), and oblique faces (16) adjoin the front face in the direction of the bearing axis, which are angled on both sides with respect to the feeding direction.

8. In the cutter body in accordance with claim 1, wherein radial grooves (13) which extend radially over an entire width of the lateral faces (12.1, 12.2) extending transversely with respect to the bearing axis, are cut into at least one of the lateral faces (12.1, 12.2).

9. In a cutter body having a beater (10) which has a bearing body (14) with a bearing bore (11), wherein a beater head (18) adjoins the bearing body (14) via a connecting section (15), wherein the bearing body (14) has lateral faces (12.1. 12.2) that receive the bore openings and are arranged on sides transversely with respect to a bearing axis of the bearing bore (11), the improvement comprising:

at least one of the lateral faces (12.1, 12.2) being formed in a plurality of segments, the connecting section (15) at least one of formed asymmetrically on the bearing body (14) in a direction of the bearing axis and maintaining the beater head (18) asymmetrically in relation to the bearing axis, and the bearing bore being one of symmetrical with respect to a center transverse plane of the connecting section (15) intersecting the bearing axis and symmetrical with respect to a mass center of gravity of the beater (10).

10. In the cutter body in accordance with claim 9, wherein for symmetry the bearing bore (11) has a clearance (10.3) in a partial area, which increases a diameter.

11. In a cutter body having a beater (10) which has a bearing body (14) with a bearing bore (11), wherein a beater head (18) adjoins the bearing body (14) via a connecting section (15), wherein the bearing body (14) has lateral faces (12.1, 12.2) that receive the bore openings and are arranged on sides transversely with respect to a bearing axis of the bearing bore (11), the improvement comprising:

at least one of the lateral faces (12.1, 12.2) being formed in a plurality of segments, and the connecting section (15) supported on the bearing body (14) by at least one strip (10.2).

12. In a cutter body having a beater (10) which has a bearing body (14) with a bearing bore (11), wherein a beater head (18) adjoins the bearing body (14) via a connecting section (15), wherein the bearing body (14) has lateral faces (12.1, 12.2) that receive the bore openings and are arranged on sides transversely with respect to a bearing axis of the bearing bore (11), the improvement comprising:

at least one of the lateral faces (12.1, 12.2) being formed in a plurality of segments, the beater head (18) having at least one cutting shoulder (17.1, 17.2) near or in front of the strips, viewed in the feeding direction, the connecting section (15) having a front face between the bearing body (14) and the cutting shoulders (17.1, 17.2), and oblique faces (16) adjoining the front face in the direction of the bearing axis, which are angled on both sides with respect to the feeding direction.

* * * * *